US006342113B2

(12) United States Patent
Haszler et al.

(10) Patent No.: US 6,342,113 B2
(45) **Date of Patent: *Jan. 29, 2002**

(54) ALUMINUM-MAGNESIUM ALLOY PLATE OR EXTRUSION

(75) Inventors: Alfred Johann Peter Haszler, Vallendar (DE); Desikan Sampath, Beverwijk (NL)

(73) Assignee: Corus Aluminium Walzprodukte GmbH, Koblenz (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/785,523

(22) Filed: Feb. 20, 2001

Related U.S. Application Data

(63) Continuation of application No. 09/155,652, filed as application No. PCT/EP97/01623 on Mar. 27, 1999, now Pat. No. 6,238,495.

(30) Foreign Application Priority Data

Apr. 4, 1996 (EP) ..... 96200967

(51) Int. Cl.[7] ..... C22C 21/06

(52) U.S. Cl. ..... 148/440; 148/439; 420/542; 420/590

(58) Field of Search ..... 148/440, 439; 420/542, 590

(56) References Cited

U.S. PATENT DOCUMENTS

| | | | | |
|---|---|---|---|---|
| 2,106,827 | A | 2/1938 | Brown | 148/440 |
| 3,502,448 | A | 3/1970 | Anderson et al. | 148/440 |
| 4,082,578 | A | 4/1978 | Evancho et al. | 148/535 |
| 4,108,688 | A | 8/1978 | Broverman | 148/549 |
| 4,238,233 | A | 12/1980 | Yamada et al. | 420/541 |
| 4,412,870 | A | 11/1983 | Vernam et al. | 148/691 |
| 4,531,977 | A | 7/1985 | Mishima et al. | 148/551 |
| 4,806,307 | A | 2/1989 | Hirose et al. | 420/528 |
| 4,869,870 | A | 9/1989 | Rioja et al. | 420/532 |
| 4,968,356 | A | 11/1990 | Tanaka et al. | 148/552 |
| 5,035,754 | A | 7/1991 | Sakiyama et al. | 148/701 |
| 5,122,196 | A | 6/1992 | Fernandez | 148/552 |
| 5,151,136 | A | 9/1992 | Witters et al. | 148/689 |
| 5,181,969 | A | 1/1993 | Komatsubara et al. | 148/552 |
| 5,234,759 | A | 8/1993 | Inabayashi et al. | 428/330 |
| 5,240,522 | A | 8/1993 | Tanaka et al. | 148/693 |
| 5,244,516 | A | 9/1993 | Kawaguchi | 148/551 |
| 5,516,374 | A | 5/1996 | Habu et al. | 148/552 |
| 5,667,602 | A | 9/1997 | Fang et al. | 148/549 |
| 5,908,518 | A | 6/1999 | Hoffmann et al. | 148/440 |

FOREIGN PATENT DOCUMENTS

| | | |
|---|---|---|
| CN | 1005993 | 12/1989 |
| DE | 2716799 | 10/1977 |
| GB | 1458181 | 12/1976 |
| GB | 2000806 | 1/1979 |
| GB | 2024861 | 1/1980 |
| JP | 56169745 | 12/1981 |
| JP | 6217147 | 1/1987 |
| JP | 62099445 | 5/1987 |
| JP | 62240740 | 10/1987 |
| JP | 1198456 | 8/1989 |
| JP | 1225740 | 9/1989 |
| JP | 4259346 | 9/1992 |
| JP | 5025573 | 2/1993 |
| JP | 5025574 | 2/1993 |
| JP | 5098404 | 4/1993 |
| JP | 5169290 | 7/1993 |
| JP | 5331587 | 12/1993 |
| JP | 6346177 | 12/1994 |
| JP | 7041896 | 2/1995 |
| JP | 7310153 | 11/1995 |
| WO | 9212269 | 7/1992 |

OTHER PUBLICATIONS

"Corrosion Behavior of Aluminium Alloys", by T.J. Summerson and D.O. Sprowls, in Aluminium Alloys, Their Physical and Mechanical Properties, International Conference held at the University of Virginia, Charlottesville, VA, Jun. 15–20, 1986, vol. III, pp. 1575–1662.

"Corrosion tests", Official Journal of the European Community, Sep. 13, 1974, No. C–104/84.

"On the Fabrication Aspect of Commercial Superplastic 5083 Aluminium Alloy Sheets", by H.S. Yang, M. Shaarbaf and K.R. Brown, in Superplasticty and Superplastic Forming, Edited by Amit K. Ghosh and Thomas R. Bieler, The Minerals, Metals & Materials Society, Las Vegas, USA, Feb. 13–15, 1995, pp. 17–24.

Evolution structurale par revenu des alliages aluminium–magnesium 7% et role du Mg2Si dans la sensibilisation a la corrosion intercristalline, by Adrien Saulnier, Rev. Aluminium 1955, 226, 1011–1014.

"Microstructural control during processing of aluminium canning alloys", by G.J. Marshall, ICAA–% Part 1, Grenoble, France, Jul. 1–5, 1996, Materials Science Forum, 217–222, (1), pp. 19–30, 1996.

(List continued on next page.)

*Primary Examiner*—Sikyin Ip
(74) *Attorney, Agent, or Firm*—Steven, Davis, Miller & Mosher, LLP

(57) ABSTRACT

A high strength Al—Mg alloy in plate or extrusion form having significantly improved strength in both soft and work-hardened tempers as compared with AA5083 is provided. The materials have ductility, pitting, stress and exfoliation corrosion resistances equivalent to those of the AA5083. The materials have improved long term stress and exfoliation corrosion resistances at temperatures above 80° C. The composition is 5–6% Mg, >0.6–1.2% Mn, 0.4–1.5% Zn, 0.05–0.25% Zr, up to 0.3% Cr, up to 0.2% Ti, up to 0.5% each Fe and Si, up to 0.4% each Cu and Ag, remainder Al and inevitable impurities. Manufacture of plate of this alloy is by homogenizing an ingot, hot rolling the ingot into plate in the range 400–530° C., cold rolling the plate with or without inter-annealing, final and optionally inter-annealing of the cold rolled material at temperatures in the range 200–550° C.

24 Claims, No Drawings

OTHER PUBLICATIONS

Registration Record of International Alloy Designations and Chemical Composition Limits for Wrought Aluminum and Wrought Aluminum Alloys by The Aluminum Association, revised Apr. 1991.

"Aluminium, Properties and Physical Metallurgy" by John E. Hatch, American Society for Metals, Metals Park, Ohio, USA, fifth printing, pp. 47, 232, 233, 269 and 281 (Jan. 1993).

ASM Specialty Handbook. Aluminium and Aluminum Alloys, edited by J.R. Davis, ASM International, Third printing, pp. 60, 61 and 678, May 1994.

Japanese Office Action in corresponding Japanese patent application 535649/97, mailed Jun. 27, 2000.

Sampath et al, Tensile Properties, Corrosion Resistance and Bendability of Plates and Welded Panels of the ALUSTAR Alloy, Report No. 87373, pp. 1–10 and two Inspection Certificates, Apr. 1997.

Van Horn, K., Aluminium, Properties and Physical Metallurgy, ASM, vol. 1 p. 208 (1967).

Campbell, Hector S., The Metallurgy of Light Alloys, "Superior Stress Corrosion Resistance of Wrought Aluminium–Magesium Alloys Containing 1% Zinc", pp. 82–100 (1983).

"Aluminun, Properties and Physical Metallurgy", by John E. Hatch, American Society for Metals, Metals Park, Ohio, USA, fifth printing, pp. 105, 106, 136–138, Jan. 1993.

"ASM Specialty Handbook. Aluminum and Aluminum Alloys", edited by J.R. Davis, ASM International, Third printing, pp. 262–274, May 1994.

"Composition affects tensile strength of welded aluminium–magnesium alloy", B.A. Cassie et al, Metal Construction and British Welding Journal, pp. 11–19 (Jan. 1973).

"The Effect of Silicon on the Microstructure and Properties of AA5182 Alloy Sheet" by G.J. Marshall, A.J.E. Flemming and R.A. Ricks, The 4th International Conference on Aluminum Alloys, Atlanta, Georgia, USA, Sep. 11–16, 1994, pp. 330–337.

"The Influence of Extreme Variations in Casting Parameters and Iron & Silicon Compositions on Can–End Stock (AA–5182)", by S.C. Flood, P.V. Evans, J.M. Brown and J. Worth, 124$^{th}$ TMS Annual Meeting, Las Vegas, Feb. 12–16, 1995, pp. 1127–1135.

"The effect of Fe and Si on the microstructure and properties of AA5182 alloy sheet", by G.J. Marshall, A.J.E. Flemming and R.A. Ricks, Proceedings of the International Symposium on Light Metals 1996, Montreal, Quebec, Aug. 25–29, 1996, pp. 257–267.

"Exfoliation Corrosion of 5083 alloy on Aluminium Boat Hasukappu–Maru", by Hideo Sugawara et al, vol. 33 (1992), Issue Jul., pp. 24–32, (with English language translation).

Det Norske Veritas (DNV) Approval of Manufacturer Certificate, May 5, 1997.

Press Release, by Hoogovens Aluminium Walzprodukte, May 1997.

Letter of Jun. 19, 1997 of the Aluminium Association, notifying signatories of application of a new registration for the proposed "AA5656".

ALUMINUM-MAGNESIUM ALLOY PLATE OR EXTRUSION

This application is a continuation of U.S. application Ser. No. 09/155,652, filed Feb. 24, 1999, now U.S. Pat. No. 6,238,495, which was a filing under 35 USC § 371 of PCT/EP97/01623, filed Mar. 27, 1999.

FIELD OF THE INVENTION

The present invention relates to an aluminium-magnesium alloy in the form of plates and extrusions, which is particularly suitable to be used in the construction of large welded structures such as storage containers and vessels for marine and land transportation. For example, the plates of this invention can be used in the construction of marine transportation vessels such as catamarans of monohull type, fast ferries, high speed light craft, and jet rings for the propulsion of such vessels. The alloy plates of the present invention can also be used in numerous other applications such as structural materials for LNG tanks, silos, tanker lorries and as tooling and moulding plates. Plates may have a thickness in the range of a few mm, e.g. 5 mm, up to 200 mm. Extrusions of the alloy of this invention can be used for example as stiffeners and in superstructures of marine vessels such as fast ferries.

DESCRIPTION OF THE RELATED ART

Al—Mg alloys with Mg levels >3% are extensively used in large welded constructions such as storage containers and vessels for land and marine transportation. A standard alloy of this type is the AA5083 alloy having the nominal composition, in wt %:

| | |
|---|---|
| Mg | 4.0–4.9 |
| Mn | 0.4–1.0 |
| Zn | ≦0.25 |
| Cr | 0.05–0.25 |
| Ti | ≦0.15 |
| Fe | ≦0.4 |
| Si | ≦0.4 |
| Cu | ≦0.1 |
| others (each) | ≦0.05 |
| (total) | ≦0.15 |

In particular, AA5083 alloy plates in the soft and work-hardened tempers are used in the construction of marine vessels such as ships, catamarans and high speed craft. Plates of the AA5083 alloy in the soft temper are used in the construction of tanker lorries, dump trucks, etc. The main reason for the versatility of the AA5083 alloy is that it provides good combinations of high strength (both at ambient and cryogenic temperatures), light weight, corrosion resistance, bendability, formability and weldability. The strength of the AA5083 alloy can be increased without significant loss in ductility by increasing the Mg % in the alloy. However, increasing the %Mg in Al—Mg alloys is accompanied by a drastic reduction in exfoliation and stress corrosion resistances. Recently, a new alloy AA5383 has been introduced with improved properties over AA5083 in both work-hardened and soft tempers. In this case, the improvement has been achieved primarily by optimising the existing composition of AA5083 alloy.

Some other disclosures of Al—Mg alloys found in the prior art literature will be mentioned below.

GB-A-1458181 proposes an alloy of strength increased relative to JISH 5083, containing a larger amount of Zn. The composition is, in wt %:

| | |
|---|---|
| Mg | 4–7 |
| Zn | 0.5–1.5 |
| Mn | 0.1–0.6, preferably 0.2–0.4 |
| optionally, one or more of Cr | 0.05–0.5 |
| Ti | 0.05–0.25 |
| Zr | 0.05–0.25 |

In the examples, ignoring reference examples, the Mn contents range from 0.19 to 0.44, and Zr is not employed. This alloy is described as cold fabricatable, and also as suitable for extrusion.

U.S. Pat. No. 2,985,530 describes an alloy for fabricating and welding having a much higher Zn level than AA5083. The Zn is added to effect natural age hardening of the alloy, following welding. The composition for plate is, in wt %:

| | |
|---|---|
| Mg | 4.5–5.5, preferably 4.85–5.35 |
| Mn | 0.2–0.9, preferably 0.4–0.7 |
| Zn | 1.5–2.5, preferably 1.75–2.25 |
| Cr | 0.05–0.2, preferably 0.05–0.15 |
| Ti | 0.02–0.06, preferably 0.03–0.05 |

In "The Metallurgy of Light Alloys", Institute of Metallurgy, Ser. 3 (London) 1983, by Hector S. Campbell, pages 82–100, there are described the effects of adding 1% of Zn to aluminium alloys containing 3.5–6% Mg and either 0.25 or 0.8% Mn. The Zn is said to improve tensile strength and to improve stress corrosion resistance in ageing over 10 days at 100° C. but not in ageing over 10 months at 125° C.

DE-A-2716799 proposes an aluminium alloy to be used instead of steel sheet in automobile parts, having the composition, in wt %:

| | |
|---|---|
| Mg | 3.5–5.5 |
| Zn | 0.5–2.0 |
| Cu | 0.3–1.2 |
| optionally at least one of Mn | 0.05–0.4 |
| Cr | 0.05–0.25 |
| Zr | 0.05–0.25 |
| V | 0.01–0.15 |

More than 0.4% Mn is said to reduce ductility.

SUMMARY OF THE INVENTION

One object of the present invention is to provide an Al—Mg alloy plate or extrusion with substantially improved strength in both soft and work-hardened tempers as compared to those of the standard AA5083 alloy. It is also an object to provide alloy plates and extrusions which can offer ductility, bendability, pitting, stress and exfoliation corrosion resistances at least equivalent to those of AA5083.

According to the invention there is provided an aluminium-magnesium alloy in the form of a plate or an extrusion, having the following composition in weight percent:

| | |
|---|---|
| Mg | 5.0–6.0 |
| Mn | >0.6–1.2 |
| Zn | 0.4–1.5 |

-continued

| | |
|---|---|
| Zr | 0.05–0.25 |
| Cr | 0.3 max. |
| Ti | 0.2 max. |
| Fe | 0.5 max. |
| Si | 0.5 max. |
| Cu | 0.4 max. |
| Ag | 0.4 max. |

By the invention we can provide alloy plate or extrusion having higher strength than AA5083, and particularly the welded joints of the present alloy can have higher strength than the standard AA5083 welds. Alloys of present invention have also been found with improved long term stress and exfoliation corrosion resistances at temperatures above 80° C., which is the maximum temperature of use for the AA5083 alloy.

The invention also consists in a welded structure having at least one welded plate or extrusion of the alloy set out above. Preferably the proof strength of the weld is at least 140 MPa.

It is believed that the improved properties available with the invention, particularly higher strength levels in both work-hardened and soft tempers, result from increasing the levels of Mg and Zn, and adding Zr.

The present inventors consider that poor exfoliation and stress corrosion resistances in AA5083 may be attributed to the increased extent of precipitation of anodic Mg-containing intermetallics on the grain boundaries. The stress and exfoliation corrosion resistances at higher Mg levels can be maintained by precipitating preferably Zn-containing intermetallics and relatively less Mg-containing intermetallics on the grain boundaries. The precipitation of Zn-containing intermetallics on the grain boundaries effectively reduces the volume fraction of highly anodic, binary AlMg intermetallics precipitated at the grain boundaries and thereby provides significant improvement in stress and exfoliation corrosion resistances in the alloys of the present invention at the higher Mg levels employed.

The alloy plates of the invention can be manufactured by preheating, hot rolling, cold rolling with or without interannealing and final annealing of an Al—Mg alloy slab of the selected composition. The conditions are preferably that the temperature for preheat in the range 400–530° C. and the time for homogenisation not more than 24 h. The hot rolling preferably begins at 500° C. Preferably there is 20–60% cold rolling of the hot rolled plate with or without interannealing after 20% reduction. The final and intermediate annealing is preferably at temperatures in the range 200–530° C. with a heat-up period of 1–10 h, and soak period at the annealing temperature in the range 10 min to 10 h. The annealing may be carried out after the hot rolling step and the final plate may be stretched by a maximum of 6%.

Details of extrusion processes are given below.

The reasons for the limitations of the alloying elements and the processing conditions of the aluminium alloy according to the present invention are described below.

All composition percentages are by weight.

Mg: Mg is the primary strengthening element in the alloy. Mg levels below 5.0% do not provide the required weld strength and when the addition exceeds 6.0%, severe cracking occurs during hot rolling. The preferred level of Mg is 5.0–5.6%, more preferably 5.2–5.6%, as a compromise between ease of fabrication and strength.

Mn: Mn is an essential additive element. In combination with Mg, Mn provides the strength in both the plate and the welded joints of the alloy. Mn levels below 0.6% cannot provide sufficient strength to the welded joints of the alloy. Above 1.2% the hot rolling becomes increasingly difficult. The preferred minimum for Mn is 0.7% for strength and the preferred range for Mn is 0.7–0.9% which represents a compromise between strength and ease of fabrication.

Zn: Zn is an important additive for corrosion resistance of the alloy. Zn also contributes to some extent to the strength of the alloy in the work-hardened tempers. Below 0.4%, the Zn addition does not provide the intergranular corrosion resistance equivalent to that of AA5083. At Zn levels above 1.5%, casting and subsequent hot rolling becomes difficult especially at industrial scale. For this reason the preferred maximum level of Zn is 1.4%. Because Zn above 0.9% may lead to corrosion in a heat-affected zone of the weld, it is preferred to use not more than 0.9% Zn.

Zr: Zr is important for achieving strength improvements in the work-hardened tempers of the alloy. Zr is also important for resistance against cracking during welding of the plates of the alloy. Zr levels above 0.25% tend to result in very coarse needle-shaped primary particles which decreases ease of fabrication of the alloy and bendability of the alloy plates, and therefore the Zr level must be not more than 0.25%. The minimum level of Zr is 0.05% and to provide sufficient strength in the work-hardened tempers a preferred Zr range of 0.10–0.20% is employed.

Ti: Ti is important as a grain refiner during solidification of both ingots and welded joints produced using the alloy of the invention. However, Ti in combination with Zr forms undesirable coarse primaries. To avoid this, Ti levels must be not more than 0.2% and the preferred range for Ti is not more than 0.1%. A suitable minimum level for Ti is 0.03%

Fe: Fe forms Al—Fe—Mn compounds during casting, thereby limiting the beneficial effects due to Mn. Fe levels above 0.5% causes formation of coarse primary particles which decrease the fatigue life of the welded joints of the alloy of the invention. The preferred range for Fe is 0.15–0.30%, more preferably 0.20–0.30%.

Si: Si forms $Mg_2Si$ which is practically insoluble in Al—Mg alloys containing Mg>4.5%. Therefore Si limits the beneficial effects of Mg. Si also combines with Fe to form coarse Al—Fe—Si phase particles which can affect the fatigue life of the welded joints of the alloy. To avoid the loss in primary strengthening element Mg, the Si level must be not more than 0.5%. The preferred range for Si is 0.07–0.20%, more preferably 0.10–0.20%.

Cr: Cr improves the corrosion resistance of the alloy. However, Cr limits the solubility of Mn and Zr. Therefore, to avoid formation of coarse primaries, the Cr level must be not more than 0.3%. A preferred range for Cr is 0–0.15%.

Cu: Cu should be not more than 0.4%. Cu levels above 0.4% gives rise to unacceptable deterioration in pitting corrosion resistance of the alloy plates of the invention. The preferred level for Cu is not more than 0.15%, more preferably not more than 0.1%.

Ag: Ag may optionally be included in the alloy up to a maximum of 0.4%, preferably at least 0.05%, to improve further the stress corrosion resistance.

The balance is Al and inevitable impurities. Typically each impurity element is present at 0.05% maximum and the total of impurities is 0.15% maximum.

Methods of making the products of the invention will now be described.

The preheating prior to hot rolling is usually carried out at a temperature in the range 400–530° C. in single or in multiple steps. In either case, preheating decreases the segregation of alloying elements in the material as cast. In multiple steps, Zr, Cr and Mn can be intentionally precipitated to control the microstructure of the hot mill exit material. If the treatment is carried out below 400° C., the resultant homogenisation effect is inadequate. Furthermore, due to substantial increase in deformation resistance of the slab, industrial hot rolling is difficult for temperatures below 400° C. If the temperature is above 530° C., eutectic melting might occur resulting in undesirable pore formation. The preferred time of the above preheat treatment is between 1 and 24 hours. The hot rolling begins preferably at about 500° C. With increase in the Mg % within the composition range of the invention, the initial pass schedule becomes more critical.

A 20–60% cold rolling reduction is preferably applied to hot rolled plate prior to final annealing. A reduction of at least 20% is preferred so that the precipitation of anodic Mg-containing intermetallics occurs uniformly during final annealing treatment. Cold rolling reductions in excess of 60% without any intermediate annealing treatment may cause cracking during rolling. In case of interannealing, the treatment is preferably carried out after a cold reduction of at least 20% to distribute the Mg- and/or Zn-containing intermetallics uniformly in the interannealed material. Final annealing can be carried out in cycles of single or multiple steps in one or more of heat-up, hold and cooling down from the annealing temperature. The heat-up period is typically between 10 min and 10 h. The annealing temperature is in the range 200–550° C. depending upon the temper. The preferred range is in between 225–275° C. to produce work-hardened tempers e.g. H321, and 350–480° C. for the soft tempers e.g. O/H111, H116 etc. The soak period at the annealing temperature is preferably between 15 min to 10 h. The cooling rate following annealing soak is preferably in the range 10–100° C./h. The conditions of the intermediate annealing are similar to those of the final annealing.

In the manufacture of extrusions, the homogenisation step is usually done at a temperature in the range 300–500° C. for a period of 1–15 h. From the soak temperature, the billets are cooled to room temperature. The homogenisation step is carried out mainly to dissolve the Mg-containing eutectics present from casting.

The preheating prior to extrusion is usually done at a temperature in the range 400–530° C. in a gas furnace for 1–24 hours or an induction furnace for 1–10 minutes. Excessively high temperature such as 530° C. is normally avoided. Extrusion can be done on an extrusion press with a one- or a multi-hole die depending on the available pressure and billet sizes. A large variation in extrusion ratio 10–100 can be applied with extrusion speeds typically in the range 1–10 m/min.

After extrusion, the extruded section can be water or air quenched. Annealing can be carried out in batch annealing furnace by heating the extruded section to a temperature in the range 200–300° C.

EXAMPLES

Example 1

Table 1 lists the chemical composition (in wt %) of the ingots used to produce soft and work-hardened temper materials. The ingots were preheated at a rate of 35° C./h to 510° C. Upon reaching the preheat temperature, the ingots were soaked for a period of 12 h prior to hot rolling. A total hot reduction of 95% was applied. A reduction of 1–2% was used in the first three passes of hot rolling. Gradually the e reduction per pass was increased. The materials exiting the mill had a temperature in the range 300±10° C. A 40% cold reduction was applied to the hot-rolled materials. The final sheet thickness was 4 mm. Soft temper materials were produced by annealing the cold-rolled materials at 525° C. for a period of 15 min. Work-hardened temper materials were produced by soaking the cold-rolled materials at 250° C. for an hour. The heat-up period was 1 h. After the heat treatments, the materials were air-cooled. The tensile properties and corrosion resistances of the resultant materials are listed in Table 2.

In Table 2, PS is proof strength in MPa, UTS is ultimate tensile strength in MPa, and Elong is maximum elongation in %. The materials were also assessed for pitting, exfoliation and intergranular corrosion resistances. The ASSET test (ASTM G66) was used to evaluate the resistances of materials to exfoliation and pitting corrosions. PA, PB, PC and PD indicate the results of the ASSET test, PA representing the best result. The ASTM G67 weight loss test was used to determine the susceptibility of the alloys to intergranular corrosion (results in $mg/cm^2$ in Table 2). Samples from welded panels of the alloys were tested to determine tensile properties of welded joints.

The alloys which are examples of the present invention are B4–B7, B11 and B13–B15. The other alloys are given for comparison. AO is a typical AA5083 alloy. The compositions listed in Table 1 are grouped in such a way that those alloys with code beginning A have Mg <5%, those alloys with code beginning B have Mg 5–6% and those alloys with code beginning C above 6% Mg.

A simple comparison of the weld strengths of code A alloys with the code B alloys clearly indicates that to obtain significantly higher weld strengths, a Mg level in excess of 5% is needed. Although increasing the Mg content results in an increased weld strength, the fact that all the three code C alloys cracked during hot rolling suggests that the ease of fabrication of the alloys deteriorates significantly if the alloy has Mg level above 6%. Increasing Mg above 5% also causes an increased susceptibility to intergranular corrosion as indicated by a weight loss value of the B3 alloy which is 17 $mg/cm^2$ (H321 temper). The comparability of the weight loss values of the alloys B4–B7 with those of the standard alloy AA5083 (alloy A0) indicates that an addition of Zn in excess of 0.4% to alloys containing Mg >5%, results in a significant improvement in resistance to intergranular corrosion.

The ASSET test results of the alloys B1 and B2 suggest that a Cu level in excess of 0.4% results in unacceptable level of pitting corrosion and therefore the Cu level in must be kept below 0.4% to achieve a pitting/exfoliation resistance comparable to those of AA5083. Although, excepting the Mn level, the compositions of the alloys B9 and B5 are comparable, the strength values of B9 in the H321 temper are lower than those of B5 implying that to obtain a higher strength, it is important to have a Mn level above 0.4%. However, severe cracking of the B10 alloy containing 1.3% Mn during hot rolling implies that 1.3% represents the maximum limit for increasing the strength in the H321 temper through Mn addition. Experience gained during several trials indicate that a Mn level in between 0.7–0.9% represents the compromise between strength increase and difficulty in fabrication.

The properties of the alloys B11, B14 and B16 can be compared to find the effect of Zr addition; the results for these alloys indicate that the Zr addition increases both the strength in the work-hardened temper and the strength of the welded joint. The fact that the alloy B16 cracked during hot rolling implies that the limit for Zr addition is below 0.3%.

Large scale trials indicated that the risk of forming coarse intermetallics is higher at Zr levels above 0.2% and therefore, a Zr level in the range 0.1–0.2% is preferred. The alloys B4, B5, B6, B7, B11, B13, B14 and B15 representing the invention have not only significantly higher strength both before and after welding as compared to those of the standard AA5083, but also have corrosion resistances similar to those of the standard alloy.

TABLE 1

| Code | Mg | Mn | Zn | Zr | Ti | Fe | Si | Cr | Cu | Al |
|---|---|---|---|---|---|---|---|---|---|---|
| A0 | 4.54 | 0.64 | 0.1 | 0.005 | 0.02 | 0.24 | 0.25 | 0.1 | 0.08 | Remainder |
| A1 | 4.22 | 0.6 | 0.1 | 0.004 | 0.01 | 0.25 | 0.25 | 0.09 | 0.3 | " |
| A2 | 4.3 | 0.6 | 0.1 | 0.04 | 0.02 | 0.24 | 0.25 | 0.1 | 0.6 | " |
| A3 | 4.38 | 0.65 | 0.1 | 0.13 | 0.01 | 0.25 | 0.27 | 0.09 | 0.05 | " |
| A4 | 4.26 | 0.64 | 0.1 | 0.215 | 0.02 | 0.25 | 0.27 | 0.09 | 0.05 | " |
| A5 | 4.33 | 0.65 | 0.1 | 0.01 | 0.01 | 0.27 | 0.28 | 0.24 | 0.06 | " |
| A6 | 4.3 | 0.64 | 0.1 | 0.005 | 0.02 | 0.23 | 0.28 | 0.24 | 0.3 | " |
| A7 | 4.2 | 0.6 | 0.1 | 0.145 | 0.01 | 0.25 | 0.29 | 0.24 | 0.3 | " |
| A8 | 4.4 | 0.63 | 0.1 | 0.145 | 0.01 | 0.23 | 0.29 | 0.24 | 0.07 | " |
| A9 | 4.7 | 0.8 | 0.4 | 0.13 | 0.14 | 0.23 | 0.14 | <0.01 | 0.1 | " |
| A10 | 4.7 | 0.8 | 0.6 | 0.13 | 0.12 | 0.23 | 0.13 | <0.01 | 0.1 | " |
| A11 | 4.8 | 0.8 | 0.4 | 0.17 | 0.02 | 0.23 | 0.13 | <0.01 | 0.1 | " |
| A12 | 4.8 | 0.8 | 0.4 | 0.25 | 0.13 | 0.25 | 0.12 | <0.01 | 0.1 | " |
| B1 | 5.0 | 0.8 | 0.2 | 0.12 | 0.09 | 0.22 | 0.13 | <0.01 | 0.4 | " |
| B2 | 5.0 | 0.8 | 0.2 | 0.12 | 0.06 | 0.23 | 0.12 | <0.01 | 0.6 | " |
| B3 | 5.1 | 0.8 | 0.1 | 0.12 | 0.1 | 0.25 | 0.13 | <0.01 | 0.1 | " |
| B4 | 5.2 | 0.8 | 0.4 | 0.12 | 0.13 | 0.25 | 0.13 | <0.01 | 0.1 | " |
| B5 | 5.3 | 0.8 | 0.53 | 0.143 | 0.05 | 0.18 | 0.09 | <0.01 | 0.06 | " |
| B6 | 5.2 | 0.8 | 1.03 | 0.13 | 0.05 | 0.18 | 0.09 | <0.01 | 0.06 | " |
| B7 | 5.1 | 0.8 | 1.4 | 0.12 | 0.05 | 0.18 | 0.09 | <0.01 | 0.05 | " |
| B8 | 5.2 | 0.8 | 1.7 | 0.12 | 0.04 | 0.17 | 0.09 | <0.01 | 0.07 | " |
| B9 | 5.3 | 0.3 | 0.5 | 0.15 | 0.09 | 0.18 | 0.1 | <0.01 | 0.1 | " |
| B10 | 5.2 | 1.3 | 0.4 | 0.12 | 0.05 | 0.17 | 0.09 | <0.01 | 0.06 | " |
| B11 | 5.6 | 0.8 | 0.52 | 0.14 | 0.05 | 0.18 | 0.09 | <0.01 | 0.05 | " |
| B12 | 5.7 | 0.8 | 0.2 | 0.12 | 0.08 | 0.25 | 0.13 | <0.01 | 0.17 | " |
| B13 | 5.7 | 0.8 | 1.05 | 0.14 | 0.05 | 0.18 | 0.09 | <0.01 | 0.05 | " |
| B14 | 5.9 | 0.8 | 0.4 | 0.23 | 0.12 | 0.25 | 0.13 | <0.01 | 0.1 | " |
| B15 | 5.9 | 0.8 | 0.6 | 0.24 | 0.15 | 0.24 | 0.15 | <0.01 | 0.1 | " |
| B16 | 5.8 | 0.8 | 0.4 | 0.3 | 0.1 | 0.24 | 0.15 | <0.01 | 0.1 | " |
| C1 | 6.2 | 0.7 | 0.6 | 0.15 | 0.1 | 0.18 | 0.1 | <0.01 | 0.09 | " |
| C2 | 6.5 | 0.8 | 1.9 | 0.15 | 0.07 | 0.16 | 0.1 | <0.01 | 0.07 | " |
| C3 | 6.1 | 1.3 | 1 | 0.15 | 0.1 | 0.19 | 0.14 | <0.01 | 0.07 | " |

TABLE 2

| | H321 Temper | | | | | O TEMPER | | | | | | | |
|---|---|---|---|---|---|---|---|---|---|---|---|---|---|
| | Tensile properties | | | Corrosion resistance | | Tensile properties | | | Corrosion resistance | | WELD [H321] Tensile properties | | |
| Code | PS | UTS | Elong | ASSET | Wt loss | PS | UTS | Elong | ASSET | Wt loss | PS | UTS | Elong |
| A0 | 285 | 361 | 9.8 | PA | 5 | 150 | 295 | 21.1 | PA | 3 | 160 | 288 | 6.4 |
| A1 | 281 | 359 | 10 | PB/PC | 2 | 155 | 305 | 23 | PC | 3 | 156 | 275 | 7 |
| A2 | 286 | 361 | 9.8 | PC | | 164 | 324 | 22.5 | PC | 2 | 155 | 270 | 6 |
| A3 | 278 | 356 | 9.7 | PA | 2 | 155 | 299 | 20.8 | PA | 3 | 150 | 276 | 7 |
| A4 | 279 | 354 | 8.8 | PA | 2 | 146 | 291 | 21.4 | PA | 3 | 153 | 278 | 6 |
| A5 | 282 | 357 | 9.2 | PA | 2 | 155 | 309 | 19 | PA | 4 | 157 | 277 | 4 |
| A6 | 290 | 359 | 9 | PB/PC | 2 | 158 | 310 | 18 | PC | 2 | 160 | 285 | 5 |
| A7 | 289 | 365 | 10 | PC | 4 | 158 | 305 | 19.1 | PA | 4 | 161 | 285 | 6 |
| A8 | 275 | 342 | 10.2 | PA | 3 | 160 | 299 | 19 | PA | 3 | 157 | 285 | 5 |
| A9 | 329 | 394 | 8.8 | PA | 3 | 170 | 323 | 20.6 | PA | 2 | 162 | 290 | 6.2 |
| A10 | 331 | 404 | 8.4 | PA | 2 | 176 | 332 | 21.4 | PA | 2 | 164 | 287 | 6.1 |
| A11 | 326 | 398 | 9.8 | PA | 3 | 172 | 328 | 21.8 | PA | 3 | 163 | 290 | 6 |
| A12 | 350 | 400 | 8.7 | PA | 2 | 168 | 322 | 21.3 | PA | 3 | 165 | 295 | 6 |
| B1 | 329 | 404 | 8.5 | PC/PD | 5 | 181 | 341 | 21.1 | PD | 4 | 170 | 298 | 6 |
| B2 | 337 | 405 | 8.7 | PD | 5 | 186 | 344 | 20.1 | PD | 7 | 171 | 307 | 6 |
| B3 | 332 | 402 | 8.9 | PB | 17 | 179 | 326 | 19.7 | PB | 20 | 173 | 310 | 6 |
| B4 | 326 | 404 | 9.7 | PA | 3 | 174 | 327 | 22.5 | PA | 2 | 187 | 310 | 6 |
| B5 | 308 | 404 | 10.4 | PB | 8 | 174 | 342 | 21.2 | PB | 10 | 190 | 319 | 5.6 |
| B6 | 314 | 416 | 10.6 | PA/PB | 4 | 175 | 344 | 22.7 | PB | 4 | 198 | 330 | 5.5 |
| B7 | 320 | 421 | 10.2 | PA/PB | 5 | 173 | 340 | 22.3 | PA | 5 | 185 | 309 | 6 |
| B8 | CRACKED DURING ROLLING | | | | | CRACKED DURING ROLLING | | | | | | | |
| B9 | 290 | 384 | 10.5 | PB | 12 | 170 | 321 | 21 | PB | 14 | 174 | 305 | 6 |
| B10 | CRACKED DURING ROLLING | | | | | CRACKED DURING ROLLING | | | | | | | |
| B11 | 318 | 395 | 10.1 | PB | 6 | 179 | 345 | 21.2 | PB/PC | 4 | 198 | 333 | 7.0 |
| B12 | 328 | 419 | 9.7 | PB | 19 | 190 | 352 | 21.7 | PB/PC | 25 | 190 | 325 | 6 |
| B13 | 322 | 428 | 10 | PA/PB | 7 | 176 | 344 | 18.9 | PB | 5 | 195 | 313 | 5.2 |
| B14 | 331 | 427 | 9.7 | PA | 3 | 182 | 344 | 21.3 | PA | 2 | 199 | 327 | 6.2 |

TABLE 2-continued

| | H321 Temper | | | | | O TEMPER | | | | | | | |
|---|---|---|---|---|---|---|---|---|---|---|---|---|---|
| | Tensile properties | | | Corrosion resistance | | Tensile properties | | | Corrosion resistance | | WELD [H321] Tensile properties | | |
| Code | PS | UTS | Elong | ASSET | Wt loss | PS | UTS | Elong | ASSET | Wt loss | PS | UTS | Elong |
| B15 | 347 | 432 | 9.6 | PA | 2 | 187 | 356 | 22.4 | PA | 2 | 197 | 329 | 6.1 |
| B16 | CRACKED DURING ROLLING | | | | | CRACKED DURING ROLLING | | | | | | | |
| C1 | CRACKED DURING ROLLING | | | | | CRACKED DURING ROLLING | | | | | | | |
| C2 | CRACKED DURING ROLLING | | | | | CRACKED DURING ROLLING | | | | | | | |
| C3 | CRACKED DURING ROLLING | | | | | CRACKED DURING ROLLING | | | | | | | |

Example 2

DC cast ingots with composition listed in wt % in Table 3 (alloy D1) were homogenised using the conditions of 510a° C./12 h and hot rolled to plate of thickness 13 mm. The hot-rolled plates were further cold rolled to 8 mm thickness.

TABLE 3

| Element | Mg | Mn | Zn | Zr | Cu | Fe | Si | Ti | Cr | Al |
|---|---|---|---|---|---|---|---|---|---|---|
| Alloy D1 | 5.2 | 0.6 | 0.9 | 0.13 | <0.1 | 0.2 | 0.1 | 0.024 | <0.01 | Remainder |

The plates were subsequently annealed at 250° C. for a period of 1 h. The tensile properties and corrosion resistances of the plates were determined. ASTM G66 and ASTM G67 were used to assess susceptibilities to pitting and exfoliation and intergranular corrosion. The properties of the alloy D1 before welding are listed in Table 4 and compared with those of the standard AA5083 alloy. Each item of data listed in Table 4 is an average of ten tests carried out on samples produced from alloy D1. It is obvious from Table 4 that the alloy D1 has not only significantly higher proof and ultimate tensile strengths than the standard AA5083 alloy but also has similar levels of resistance to pitting, exfoliation and intergranular corrosion.

TABLE 4

| Property | AA5083 | Alloy D1 |
|---|---|---|
| Proof strength [MPA] | 257 | 305 |
| Ultimate Tensile Strength [MPa] | 344 | 410 |
| Elongation [%] | 16.3 | 14 |
| ASSET Test Result | PB | PA/PB |
| Weight loss test result [mg/cm$^2$] | 4 | 5 |

800×800 mm welded panels of the alloy D1 were produced using a current and voltage of 190A and 23V respectively. Three passes were used to produce the welded joints. 25 cross weld tensiles were machined out from the welded panels. The filler wire used was AA5183. For reference purposes, 25 cross weld tensiles were machined out from similarly welded panels of the standard AA5083 alloy. Table 5 lists the data derived from the 25 tensile tests obtained from the 25 welded joints of each of the alloys D1/5183 and 5083/5183, as average, maximum and minimum. It is clear from the data in Table 5 that the alloy D1 has significantly higher proof and ultimate tensile strengths as compared to those of the standard AA5083 alloy in the welded condition.

TABLE 5

| | Alloy 5083/5183 | | | Alloy D1/5183 | | |
|---|---|---|---|---|---|---|
| | PS MPa | UTS MPa | Elongation % | PS MPa | UTS MPa | Elongation % |
| Average | 139 | 287 | 17.2 | 176 | 312 | 15.8 |
| Minimum | 134 | 281 | 11.4 | 164 | 298 | 11.8 |
| Maximum | 146 | 294 | 21.9 | 185 | 325 | 21.1 |

Example 3

DC cast ingots with the same composition as alloy D1 of Example 2 were homogenised using conditions of 510° C./12 h and hot rolled to plate of thickness 13 mm. The hot rolled plates were further cold rolled to 8 mm thick plates. The plates were subsequently annealed at 350° C. for a period of 1 h. Thus produced 'O' temper plates were subsequently heat treated by soaking samples at 100° C. for various periods from 1 h to 30 days. For the reference purposes, samples from 8 mm, O temper AA5083 plates were also heat treated in parallel to these samples from alloy D1. The microstructures of the samples were characterized using a Scanning Electron Microscope. Examination of the samples of AA5083 exposed to 100° C. showed the precipitation of anodic intermetallics on the grain boundaries. It was also observed that as the exposure time at 100° C. is increased, the boundary precipitation becomes more intensive. It becomes so intensive that eventually a continuous boundary network of anodic intermetallics is resulted. However, unlike the case of the standard AA5083 alloy, the samples of the alloy D1 were found to contain precipitation of anodic intermetallics within the grains even after prolonged exposure at 100° C. Since it is known that continuous boundary network of anodic intermetallics is responsible for stress corrosion cracking, the use of the standard AA5083 alloy is restricted to applications where service temperature is less than 80° C. However, since the chemistry of the alloy D1 does not allow any continuous grain boundary precipitation even after prolonged exposure at 100° C., it can be concluded that this alloy is suitable for use in applications where service temperature is above 80° C.

What is claimed is:

1. Aluminium-magnesium alloy, consisting of the following composition in weight percent:

| | |
|---|---|
| Mg | 5.0–6.0 |
| Mn | >0.6–1.2 |
| Zn | 0.4–1.5 |

-continued

| | |
|---|---|
| Zr | 0.05–0.25 |
| Cr | 0.3 max. |
| Ti | 0.2 max. |
| Fe | 0.5 max. |
| Si | 0.5 max. |
| Cu | 0.4 max. |
| Ag | 0.4 max. |

balance Al and unavoidable impurities, wherein each impurity element is present at a maximum amount of 0.05% and the total weight of impurities is a maximum of 0.15%.

2. Aluminium-magnesium alloy according to claim 1, having a temper selected from a soft temper and a work hardened temper.

3. Aluminium-magnesium alloy according to claim 1, wherein the Mg content is in the range 5.0–5.6 wt %.

4. Aluminium-magnesium alloy according to any one of claim 1, wherein the Mn content is at least 0.7 wt %.

5. Aluminium-magnesium alloy according to claim 4, wherein the Mn content is in the range 0.7–0.9 wt %.

6. Aluminium-magnesium alloy according to claim 1, wherein the Zn content is not more than 1.4 wt %.

7. Aluminium-magnesium alloy according to claim 6, wherein the Zn content is not more than 0.9 wt %.

8. Aluminium-magnesium alloy according to claim 1, wherein the Zr content is in the range 0.10–0.20 wt %.

9. Aluminium-magnesium alloy according to claim 1, wherein the Mg content is in the range 5.2–5.6 wt %.

10. Aluminium-magnesium alloy according to claim 1, wherein the Cr content is not more than 0.15 wt %.

11. Aluminium-magnesium alloy according to claim 1, wherein the Ti content is not more than 0.10 wt %.

12. Aluminium-magnesium alloy according to claim 1, wherein the Fe content is in the range 0.2–0.3 wt %.

13. Aluminium-magnesium alloy according to claim 1, wherein the Si content is in the range 0.1–0.2 wt %.

14. Aluminium-magnesium alloy according to claim 1, wherein the Cu content is not more than 0.1 wt %.

15. Welded structure comprising at least one welded plate made of aluminium-magnesium alloy according to claim 1.

16. Welded structure according to claim 15, wherein the proof strength of the weld of said plate or extrusion is at least 140 MPa.

17. A method of use of an aluminium-magnesium alloy according to claim 1, comprising subjecting a structure which comprises a plate or extrusion of said alloy to an operating temperature greater than 80° C.

18. A plate comprising the aluminum-magnesium alloy according to claim 1.

19. An extrusion comprising the aluminum-magnesium alloy according to claim 1.

20. An extruded product comprising the aluminum-magnesium alloy according to claim 1.

21. Aluminium-magnesium alloy according to claim 1 having an O- temper and a work-hardened temper.

22. Aluminium-magnesium alloy according to claim 1 having an H321-temper.

23. Welded structure comprising at least one welded extrusion made of aluminium-magnesium alloy according to claim 1.

24. Aluminium-magnesium alloy according to claim 1, wherein the Ag content is in the range 0.05–0.4 wt %.

* * * * *